US011959371B2

(12) United States Patent
Oehring et al.

(10) Patent No.: US 11,959,371 B2
(45) Date of Patent: Apr. 16, 2024

(54) SUCTION AND DISCHARGE LINES FOR A DUAL HYDRAULIC FRACTURING UNIT

(71) Applicant: US Well Services LLC, Houston, TX (US)

(72) Inventors: Jared Oehring, Houston, TX (US); Robert Kurtz, Houston, TX (US)

(73) Assignee: US Well Services, LLC, Houston, TX (US)

( * ) Notice: Subject to any disclaimer, the term of this patent is extended or adjusted under 35 U.S.C. 154(b) by 0 days.

(21) Appl. No.: 15/145,443

(22) Filed: May 3, 2016

(65) Prior Publication Data

US 2016/0319650 A1 Nov. 3, 2016

Related U.S. Application Data

(63) Continuation-in-part of application No. 13/679,689, filed on Nov. 16, 2012, now Pat. No. 9,410,410.

(60) Provisional application No. 62/156,301, filed on May 3, 2015.

(51) Int. Cl.
*E21B 43/26* (2006.01)
*E21B 43/267* (2006.01)

(52) U.S. Cl.
CPC ..... *E21B 43/2607* (2020.05); *E21B 43/267* (2013.01)

(58) Field of Classification Search
CPC ..... E21B 43/26
USPC ..... 137/351, 899.4
See application file for complete search history.

(56) References Cited

U.S. PATENT DOCUMENTS

| | | | |
|---|---|---|---|
| 1,656,861 | A | 1/1928 | Leonard |
| 1,671,436 | A | 5/1928 | Melott |
| 2,004,077 | A | 6/1935 | McCartney |
| 2,183,364 | A | 12/1939 | Bailey |
| 2,220,622 | A | 11/1940 | Aitken |
| 2,248,051 | A | 7/1941 | Armstrong |
| 2,407,796 | A | 9/1946 | Page |
| 2,416,848 | A | 3/1947 | Rothery |
| 2,610,741 | A | 9/1952 | Schmid |
| 2,753,940 | A | 7/1956 | Bonner |
| 2,976,025 | A | 3/1961 | Pro |

(Continued)

FOREIGN PATENT DOCUMENTS

| | | |
|---|---|---|
| AU | 2007340913 | 7/2008 |
| CA | 2406801 | 11/2001 |

(Continued)

OTHER PUBLICATIONS

Non-Final Office Action issued in corresponding U.S. Appl. No. 15/293,681 dated Feb. 16, 2017.

(Continued)

*Primary Examiner* — Steven A MacDonald
(74) *Attorney, Agent, or Firm* — Hogan Lovells US LLP

(57) ABSTRACT

An electrically powered hydraulic fracturing system includes pumps for pressurizing fracturing fluid, piping for carrying fracturing fluid, and field connections in obliquely oriented segments of the piping. The connections are between lead lines that couple directly to the pumps and lines carrying fluid to and from the pump; and are assembled and disassembled in the field. Operations personnel can more easily manipulate connections that are obliquely oriented than those that are horizontal or vertical.

4 Claims, 4 Drawing Sheets

(56) References Cited

U.S. PATENT DOCUMENTS 3,055,682 A 9/1962 Bacher
3,061,039 A 10/1962 Peters
3,066,503 A 12/1962 Fleming
3,302,069 A 1/1967 Webster
3,334,495 A 8/1967 Jensen
3,722,595 A 3/1973 Kiel
3,764,233 A 10/1973 Strickland
3,773,140 A 11/1973 Mahajan
3,837,179 A 9/1974 Barth
3,849,662 A 11/1974 Blaskowski
3,878,884 A 4/1975 Raleigh
3,881,551 A 5/1975 Terry
4,037,431 A 7/1977 Sugimoto
4,100,822 A 7/1978 Rosman
4,151,575 A 4/1979 Hogue
4,226,299 A 10/1980 Hansen
4,265,266 A 5/1981 Kierbow et al.
4,411,313 A 10/1983 Johnson et al.
4,432,064 A 2/1984 Barker
4,442,665 A 4/1984 Fick et al.
4,456,092 A 6/1984 Kubozuka
4,506,982 A 3/1985 Smithers et al.
4,512,387 A 4/1985 Rodriguez
4,529,887 A 7/1985 Johnson
4,538,916 A 9/1985 Zimmerman
4,601,629 A 7/1986 Zimmerman
4,676,063 A 6/1987 Goebel et al.
4,759,674 A 7/1988 Schroder
4,768,884 A 9/1988 Elkin
4,793,386 A * 12/1988 Sloan ..... E03F 7/10 137/351
4,845,981 A 7/1989 Pearson
4,922,463 A 5/1990 Del Zotto et al.
5,004,400 A 4/1991 Handke
5,006,044 A 4/1991 Walker, Sr.
5,025,861 A 6/1991 Huber
5,050,673 A 9/1991 Baldridge
5,114,239 A 5/1992 Allen
5,130,628 A 7/1992 Owen
5,131,472 A 7/1992 Dees et al.
5,172,009 A 12/1992 Mohan
5,189,388 A 2/1993 Mosley
5,230,366 A 7/1993 Marandi
5,334,899 A 8/1994 Skybyk
5,366,324 A 11/1994 Arlt
5,422,550 A 6/1995 McClanahan
5,433,243 A 7/1995 Griswold
5,439,066 A 8/1995 Gipson
5,486,047 A 1/1996 Zimmerman
5,517,822 A 5/1996 Haws et al.
5,548,093 A 8/1996 Sato
5,590,976 A 1/1997 Kilheffer et al.
5,655,361 A 8/1997 Kishi
5,736,838 A 4/1998 Dove et al.
5,755,096 A 5/1998 Holleyman
5,790,972 A 8/1998 Kohlenberger
5,798,596 A 8/1998 Lordo
5,813,455 A 9/1998 Pratt et al.
5,865,247 A 2/1999 Paterson
5,879,137 A 3/1999 Yie
5,894,888 A 4/1999 Wiemers
5,907,970 A 6/1999 Havlovick et al.
5,950,726 A 9/1999 Roberts
6,035,265 A 3/2000 Dister et al.
6,097,310 A 8/2000 Harrell et al.
6,121,705 A 9/2000 Hoong
6,138,764 A 10/2000 Scarsdale et al.
6,142,878 A 11/2000 Barin
6,164,910 A 12/2000 Mayleben
6,202,702 B1 3/2001 Ohira
6,208,098 B1 3/2001 Kume
6,254,462 B1 7/2001 Kelton
6,271,637 B1 8/2001 Kushion
6,273,193 B1 8/2001 Hermann et al.
6,315,523 B1 11/2001 Mills
6,442,942 B1 9/2002 Kopko
6,477,852 B2 11/2002 Dodo
6,484,490 B1 11/2002 Olsen
6,491,098 B1 12/2002 Dallas
6,529,135 B1 3/2003 Bowers et al.
6,585,455 B1 7/2003 Petersen et al.
6,626,646 B2 9/2003 Rajewski
6,719,900 B2 4/2004 Hawkins
6,765,304 B2 7/2004 Baten et al.
6,776,227 B2 8/2004 Beida
6,788,022 B2 9/2004 Sopko
6,802,690 B2 10/2004 Han
6,808,303 B2 10/2004 Fisher
6,931,310 B2 8/2005 Shimizu et al.
6,936,947 B1 8/2005 Leijon
6,985,750 B1 1/2006 Vicknair et al.
7,082,993 B2 8/2006 Ayoub
7,104,233 B2 9/2006 Ryczek et al.
7,170,262 B2 1/2007 Pettigrew
7,173,399 B2 2/2007 Sihler
7,308,933 B1 12/2007 Mayfield
7,312,593 B1 12/2007 Streicher et al.
7,336,514 B2 2/2008 Amarillas
7,445,041 B2 11/2008 O'Brien
7,494,263 B2 2/2009 Dykstra et al.
7,500,642 B2 3/2009 Cunningham
7,525,264 B2 4/2009 Dodge
7,563,076 B2 7/2009 Brunet
7,581,379 B2 9/2009 Yoshida
7,675,189 B2 3/2010 Grenier
7,683,499 B2 3/2010 Saucier
7,717,193 B2 5/2010 Egilsson et al.
7,755,310 B2 7/2010 West et al.
7,795,830 B2 9/2010 Johnson
7,807,048 B2 10/2010 Collette
7,835,140 B2 11/2010 Mori
7,845,413 B2 12/2010 Shampine
7,926,562 B2 4/2011 Poitzsch
7,894,757 B2 7/2011 Keast
7,977,824 B2 7/2011 Halen et al.
8,037,936 B2 10/2011 Neuroth
8,054,084 B2 11/2011 Schulz et al.
8,083,504 B2 12/2011 Williams
8,091,928 B2 1/2012 Carrier
8,096,354 B2 1/2012 Poitzsch
8,096,891 B2 1/2012 Ochtefeld
8,139,383 B2 3/2012 Efraimsson
8,146,665 B2 4/2012 Neal
8,154,419 B2 4/2012 Daussin et al.
8,232,892 B2 7/2012 Overholt et al.
8,261,528 B2 9/2012 Chillar
8,272,439 B2 9/2012 Strickland
8,310,272 B2 11/2012 Quarto
8,354,817 B2 1/2013 Yeh et al.
8,474,521 B2 7/2013 Kajaria
8,506,267 B2 8/2013 Gambier et al.
8,534,235 B2 9/2013 Chandler
8,573,303 B2 11/2013 Kerfoot
8,596,056 B2 12/2013 Woodmansee
8,616,005 B1 12/2013 Cousino
8,616,274 B2 12/2013 Belcher et al.
8,646,521 B2 2/2014 Bowen
8,692,408 B2 4/2014 Zhang et al.
8,727,068 B2 5/2014 Bruin
8,760,657 B2 6/2014 Pope
8,763,387 B2 7/2014 Schmidt
8,774,972 B2 7/2014 Rusnak
8,789,601 B2 7/2014 Broussard
8,795,525 B2 8/2014 McGinnis et al.
8,800,652 B2 8/2014 Bartko
8,807,960 B2 8/2014 Stephenson
8,838,341 B2 9/2014 Kumano
8,851,860 B1 10/2014 Mail
8,857,506 B2 10/2014 Stone, Jr.
8,899,940 B2 12/2014 Laugemors
8,905,056 B2 12/2014 Kendrick
8,905,138 B2 12/2014 Lundstedt et al.
8,997,904 B2 4/2015 Cryer
9,018,881 B2 4/2015 Mao et al.

(56) References Cited

U.S. PATENT DOCUMENTS 9,051,822 B2 6/2015 Ayan
9,051,923 B2 6/2015 Kuo
9,061,223 B2 6/2015 Winborn
9,062,545 B2 6/2015 Roberts et al.
9,067,182 B2 6/2015 Nichols
9,103,193 B2 8/2015 Coli
9,119,326 B2 8/2015 McDonnell
9,121,257 B2 9/2015 Coli et al.
9,140,105 B2 9/2015 Pattillo
9,140,110 B2 9/2015 Coli
9,160,168 B2 10/2015 Chapel
9,175,554 B1 11/2015 Watson
9,206,684 B2 12/2015 Parra
9,260,253 B2 2/2016 Naizer
9,322,239 B2 4/2016 Angeles Boza et al.
9,324,049 B2 4/2016 Thomeer
9,340,353 B2 5/2016 Oren
9,353,593 B1 5/2016 Lu et al.
9,366,114 B2 6/2016 Coli et al.
9,410,410 B2 8/2016 Broussard et al.
9,450,385 B2 9/2016 Kristensen
9,458,687 B2 10/2016 Hallundbaek
9,475,020 B2 10/2016 Coli et al.
9,475,021 B2 10/2016 Coli et al.
9,482,086 B2 11/2016 Richardson et al.
9,499,335 B2 11/2016 McIver
9,506,333 B2 11/2016 Castillo et al.
9,513,055 B1 12/2016 Seal
9,534,473 B2 1/2017 Morris et al.
9,562,420 B2 2/2017 Morris et al.
9,587,649 B2 3/2017 Oehring
9,611,728 B2 4/2017 Oehring
9,650,879 B2 5/2017 Broussard et al.
9,706,185 B2 7/2017 Ellis
9,728,354 B2 8/2017 Skolozdra
9,738,461 B2 8/2017 DeGaray
9,739,546 B2 8/2017 Bertilsson et al.
9,745,840 B2 8/2017 Oehring et al.
9,790,858 B2 10/2017 Kanebako
9,863,228 B2 1/2018 Shampine et al.
9,909,398 B2 3/2018 Pham
9,915,128 B2 3/2018 Hunter
9,932,799 B2 4/2018 Symchuk
9,945,365 B2 4/2018 Hernandez et al.
9,963,961 B2 5/2018 Hardin
9,976,351 B2 5/2018 Randall
10,008,880 B2 6/2018 Vicknair
10,184,465 B2 1/2019 Enis et al.
10,196,878 B2 2/2019 Hunter
10,221,639 B2 3/2019 Romer et al.
10,227,854 B2 3/2019 Glass
10,232,332 B2 3/2019 Oehring
10,246,984 B2 4/2019 Payne
10,254,732 B2 4/2019 Oehring
10,260,327 B2 4/2019 Kajaria
10,280,724 B2 5/2019 Hinderliter
10,287,873 B2 5/2019 Filas
10,302,079 B2 * 5/2019 Kendrick ..... E21B 43/26
10,309,205 B2 6/2019 Randall
10,337,308 B2 7/2019 Broussard
10,371,012 B2 8/2019 Davis
10,378,326 B2 8/2019 Morris
10,393,108 B2 8/2019 Chong
10,407,990 B2 9/2019 Oehring
10,408,030 B2 9/2019 Oehring et al.
10,408,031 B2 9/2019 Oehring et al.
10,415,332 B2 9/2019 Morris et al.
10,436,026 B2 10/2019 Ounadjela
10,627,003 B2 4/2020 Dale et al.
10,648,270 B2 5/2020 Brunty et al.
10,648,311 B2 5/2020 Oehring et al.
10,669,471 B2 6/2020 Schmidt et al.
10,669,804 B2 6/2020 Kotrla
10,686,301 B2 6/2020 Oehring et al.
10,695,950 B2 6/2020 Igo et al.
10,711,576 B2 7/2020 Bishop
10,731,561 B2 8/2020 Oehring et al.
10,740,730 B2 8/2020 Altamirano et al.
10,767,561 B2 9/2020 Brady
10,781,752 B2 9/2020 Kikkawa et al.
10,794,165 B2 10/2020 Fischer et al.
10,988,998 B2 4/2021 Fischer et al.
2001/0000996 A1 5/2001 Grimland et al.
2002/0169523 A1 11/2002 Ross
2003/0056514 A1 3/2003 Lohn
2003/0079875 A1 5/2003 Weng
2003/0138327 A1 7/2003 Jones et al.
2004/0040746 A1 3/2004 Niedermayr
2004/0045703 A1 3/2004 Hooper et al.
2004/0102109 A1 5/2004 Cratty
2004/0167738 A1 8/2004 Miller
2005/0061548 A1 3/2005 Hooper
2005/0116541 A1 6/2005 Seiver
2005/0201197 A1 9/2005 Duell et al.
2005/0274508 A1 12/2005 Folk
2006/0052903 A1 3/2006 Bassett
2006/0065319 A1 3/2006 Csitari
2006/0109141 A1 5/2006 Huang
2006/0260331 A1 11/2006 Andreychuk
2007/0131410 A1 6/2007 Hill
2007/0187163 A1 8/2007 Cone
2007/0201305 A1 8/2007 Heilman et al.
2007/0226089 A1 9/2007 DeGaray et al.
2007/0277982 A1 12/2007 Shampine
2007/0278140 A1 12/2007 Mallet et al.
2008/0017369 A1 1/2008 Sarada
2008/0041596 A1 2/2008 Blount
2008/0095644 A1 4/2008 Mantei et al.
2008/0112802 A1 5/2008 Orlando
2008/0137266 A1 6/2008 Jensen
2008/0164023 A1 7/2008 Dykstra et al.
2008/0208478 A1 8/2008 Ella et al.
2008/0217024 A1 9/2008 Moore
2008/0236818 A1 10/2008 Dykstra
2008/0257449 A1 10/2008 Weinstein et al.
2008/0264625 A1 10/2008 Ochoa
2008/0264640 A1 10/2008 Eslinger
2008/0264649 A1 10/2008 Crawford
2008/0277120 A1 11/2008 Hickie
2009/0045782 A1 2/2009 Datta
2009/0065299 A1 3/2009 Vito
2009/0072645 A1 3/2009 Quere
2009/0078410 A1 3/2009 Krenek et al.
2009/0090504 A1 4/2009 Weightman
2009/0093317 A1 4/2009 Kajiwara et al.
2009/0095482 A1 4/2009 Surjaatmadja
2009/0145611 A1 6/2009 Pallini, Jr.
2009/0153354 A1 6/2009 Daussin et al.
2009/0188181 A1 7/2009 Forbis
2009/0200035 A1 8/2009 Bjerkreim et al.
2009/0260826 A1 10/2009 Sherwood
2009/0308602 A1 12/2009 Bruins et al.
2010/0000508 A1 * 1/2010 Chandler ..... F24H 1/06
126/116 R
2010/0019574 A1 1/2010 Baldassarre
2010/0038907 A1 2/2010 Hunt
2010/0045109 A1 2/2010 Arnold
2010/0051272 A1 3/2010 Loree et al.
2010/0101785 A1 4/2010 Khvoshchev
2010/0132949 A1 6/2010 DeFosse et al.
2010/0146981 A1 6/2010 Motakef
2010/0172202 A1 7/2010 Borgstadt
2010/0200224 A1 8/2010 Nguete
2010/0250139 A1 9/2010 Hobbs et al.
2010/0293973 A1 11/2010 Erickson
2010/0303655 A1 12/2010 Scekic
2010/0322802 A1 12/2010 Kugelev
2011/0005757 A1 1/2011 Hebert
2011/0017468 A1 1/2011 Birch et al.
2011/0052423 A1 3/2011 Gambier
2011/0061855 A1 3/2011 Case et al.
2011/0081268 A1 4/2011 Ochoa et al.
2011/0085924 A1 4/2011 Shampine
2011/0110793 A1 5/2011 Leugemores et al.

(56) References Cited

U.S. PATENT DOCUMENTS

2011/0166046 A1 7/2011 Weaver
2011/0247878 A1 10/2011 Rasheed
2011/0272158 A1 11/2011 Neal
2012/0018016 A1 1/2012 Gibson
2012/0049625 A1 3/2012 Hopwood
2012/0060929 A1* 3/2012 Kendrick ..... E21B 21/062 137/1
2012/0063936 A1 3/2012 Baxter et al.
2012/0085541 A1 4/2012 Love et al.
2012/0112757 A1 5/2012 Vrankovic et al.
2012/0127635 A1 5/2012 Grindeland
2012/0150455 A1 6/2012 Franklin et al.
2012/0152716 A1 6/2012 Kikukawa et al.
2012/0205301 A1 8/2012 McGuire et al.
2012/0205400 A1 8/2012 DeGaray et al.
2012/0222865 A1 9/2012 Larson
2012/0232728 A1 9/2012 Karimi
2012/0247783 A1 10/2012 Berner, Jr.
2012/0255734 A1* 10/2012 Coli ..... E21B 43/26 166/305.1
2013/0009469 A1 1/2013 Gillett
2013/0025706 A1 1/2013 DeGaray et al.
2013/0051971 A1 2/2013 Wyse et al.
2013/0175038 A1 7/2013 Conrad
2013/0175039 A1 7/2013 Guidry
2013/0180722 A1 7/2013 Olarte Caro
2013/0189629 A1 7/2013 Chandler
2013/0199617 A1 8/2013 DeGaray et al.
2013/0233542 A1 9/2013 Shampine
2013/0255271 A1 10/2013 Yu et al.
2013/0284278 A1 10/2013 Winborn
2013/0284455 A1 10/2013 Kajaria et al.
2013/0299167 A1 11/2013 Fordyce
2013/0306322 A1 11/2013 Sanborn
2013/0317750 A1 11/2013 Hunter
2013/0341029 A1 12/2013 Roberts et al.
2013/0343858 A1 12/2013 Flusche
2014/0000899 A1 1/2014 Nevison
2014/0010671 A1 1/2014 Cryer et al.
2014/0054965 A1 2/2014 Jain
2014/0060658 A1 3/2014 Hains
2014/0095114 A1 4/2014 Thomeer
2014/0096974 A1 4/2014 Coli
2014/0124162 A1 5/2014 Leavitt
2014/0138079 A1 5/2014 Broussard
2014/0174717 A1 6/2014 Broussard et al.
2014/0219824 A1 8/2014 Burnette
2014/0238683 A1 8/2014 Korach
2014/0246211 A1 9/2014 Guidry
2014/0251623 A1 9/2014 Lestz et al.
2014/0255214 A1 9/2014 Burnette
2014/0277772 A1 9/2014 Lopez
2014/0290768 A1 10/2014 Randle
2014/0379300 A1 12/2014 Devine
2015/0027712 A1 1/2015 Vicknair
2015/0053426 A1 2/2015 Smith
2015/0068724 A1 3/2015 Coli et al.
2015/0068754 A1 3/2015 Coli et al.
2015/0075778 A1 3/2015 Walters
2015/0083426 A1 3/2015 Lesko
2015/0097504 A1 4/2015 Lamascus
2015/0114652 A1 4/2015 Lestz
2015/0136043 A1 5/2015 Shaaban
2015/0144336 A1 5/2015 Hardin et al.
2015/0147194 A1 5/2015 Foote
2015/0159911 A1 6/2015 Holt
2015/0175013 A1 6/2015 Cryer et al.
2015/0176386 A1 6/2015 Castillo et al.
2015/0211512 A1 7/2015 Wiegman
2015/0211524 A1 7/2015 Broussard
2015/0217672 A1 8/2015 Shampine
2015/0225113 A1 8/2015 Lungu
2015/0233530 A1 8/2015 Sandidge
2015/0252661 A1 9/2015 Glass
2015/0300145 A1 10/2015 Coli et al.
2015/0300336 A1 10/2015 Hernandez
2015/0314225 A1 11/2015 Coli et al.
2015/0330172 A1 11/2015 Allmaras
2015/0354322 A1 12/2015 Vicknair
2016/0006311 A1 1/2016 Li
2016/0032703 A1 2/2016 Broussard et al.
2016/0102537 A1 4/2016 Lopez
2016/0105022 A1 4/2016 Oehring
2016/0208592 A1 4/2016 Oehring
2016/0160889 A1 6/2016 Hoffman et al.
2016/0177675 A1 6/2016 Morris et al.
2016/0177678 A1 6/2016 Morris
2016/0186531 A1 6/2016 Harkless et al.
2016/0208593 A1 7/2016 Coli et al.
2016/0208594 A1 7/2016 Coli et al.
2016/0208595 A1 7/2016 Tang
2016/0221220 A1 8/2016 Paige
2016/0230524 A1 8/2016 Dumoit
2016/0230525 A1 8/2016 Lestz et al.
2016/0230660 A1 8/2016 Zeitoun et al.
2016/0258267 A1 9/2016 Payne
2016/0265457 A1 9/2016 Stephenson
2016/0273328 A1 9/2016 Oehring
2016/0273456 A1 9/2016 Zhang et al.
2016/0281484 A1 9/2016 Lestz
2016/0290114 A1 10/2016 Oehring
2016/0290563 A1 10/2016 Diggins
2016/0312108 A1 10/2016 Lestz et al.
2016/0319650 A1 11/2016 Oehring
2016/0326853 A1 11/2016 Fred et al.
2016/0326854 A1 11/2016 Broussard
2016/0326855 A1 11/2016 Coli et al.
2016/0341281 A1 11/2016 Brunvold et al.
2016/0348479 A1 12/2016 Oehring
2016/0349728 A1 12/2016 Oehring
2016/0369609 A1 12/2016 Morris et al.
2017/0016433 A1 1/2017 Chong
2017/0021318 A1 1/2017 McIver et al.
2017/0022788 A1 1/2017 Oehring et al.
2017/0022807 A1 1/2017 Dursun
2017/0028368 A1 2/2017 Oehring et al.
2017/0030177 A1 2/2017 Oehring
2017/0030178 A1 2/2017 Oehring et al.
2017/0036178 A1 2/2017 Coli et al.
2017/0036872 A1 2/2017 Wallace
2017/0037717 A1 2/2017 Oehring
2017/0037718 A1 2/2017 Coli et al.
2017/0043280 A1 2/2017 Vankouwenberg
2017/0051732 A1 2/2017 Hemandez et al.
2017/0074076 A1 3/2017 Joseph et al.
2017/0082033 A1 3/2017 Wu et al.
2017/0096885 A1 4/2017 Oehring
2017/0096889 A1 4/2017 Blanckaert et al.
2017/0104389 A1 4/2017 Morris et al.
2017/0114625 A1 4/2017 Norris
2017/0130743 A1 5/2017 Anderson
2017/0138171 A1 5/2017 Richards et al.
2017/0146189 A1 5/2017 Herman
2017/0159570 A1 6/2017 Bickert
2017/0159654 A1* 6/2017 Kendrick ..... E21B 43/26
2017/0175516 A1 6/2017 Eslinger
2017/0204852 A1 7/2017 Barnett
2017/0212535 A1 7/2017 Shelman et al.
2017/0218727 A1 8/2017 Oehring
2017/0218843 A1 8/2017 Oehring et al.
2017/0222409 A1 8/2017 Oehring et al.
2017/0226838 A1 8/2017 Ciezobka
2017/0226842 A1 8/2017 Omont
2017/0234250 A1 8/2017 Janik
2017/0241221 A1 8/2017 Seshadri
2017/0259227 A1 9/2017 Morris et al.
2017/0292513 A1 10/2017 Haddad
2017/0313499 A1 11/2017 Hughes et al.
2017/0314380 A1 11/2017 Oehring
2017/0314979 A1 11/2017 Ye
2017/0328179 A1 11/2017 Dykstra
2017/0369258 A1 12/2017 DeGaray
2017/0370639 A1 12/2017 Barden et al.
2018/0028992 A1 2/2018 Stegemoeller

(56) References Cited

U.S. PATENT DOCUMENTS

| | | | |
|---|---|---|---|
| 2018/0038216 | A1 | 2/2018 | Zhang |
| 2018/0045331 | A1 | 2/2018 | Lopez |
| 2018/0090914 | A1 | 3/2018 | Johnson et al. |
| 2018/0181830 | A1 | 6/2018 | Luharuka et al. |
| 2018/0216455 | A1 | 8/2018 | Andreychuk |
| 2018/0238147 | A1 | 8/2018 | Shahri |
| 2018/0245428 | A1 | 8/2018 | Richards |
| 2018/0259080 | A1 | 9/2018 | Dale et al. |
| 2018/0266217 | A1 | 9/2018 | Funkhauser et al. |
| 2018/0266412 | A1 | 9/2018 | Stokkevag |
| 2018/0284817 | A1 | 10/2018 | Cook et al. |
| 2018/0291713 | A1 | 10/2018 | Jeanson |
| 2018/0298731 | A1 | 10/2018 | Bishop |
| 2018/0312738 | A1 | 11/2018 | Rutsch et al. |
| 2018/0313677 | A1 | 11/2018 | Warren et al. |
| 2018/0320483 | A1 | 11/2018 | Zhang |
| 2018/0343125 | A1 | 11/2018 | Clish |
| 2018/0363437 | A1 | 12/2018 | Coli |
| 2018/0363640 | A1 | 12/2018 | Kajita et al. |
| 2018/0366950 | A1 | 12/2018 | Pedersen et al. |
| 2019/0003329 | A1 | 1/2019 | Morris |
| 2019/0010793 | A1 | 1/2019 | Hinderliter |
| 2019/0040727 | A1 | 2/2019 | Oehring et al. |
| 2019/0063309 | A1 | 2/2019 | Davis |
| 2019/0100989 | A1 | 4/2019 | Stewart |
| 2019/0112910 | A1 | 4/2019 | Oehring |
| 2019/0119096 | A1 | 4/2019 | Haile |
| 2019/0120024 | A1 | 4/2019 | Oehring |
| 2019/0128080 | A1 | 5/2019 | Ross |
| 2019/0128104 | A1 | 5/2019 | Graham et al. |
| 2019/0145251 | A1 | 5/2019 | Johnson |
| 2019/0154020 | A1 | 5/2019 | Glass |
| 2019/0162061 | A1 | 5/2019 | Stephenson |
| 2019/0169971 | A1 | 6/2019 | Oehring |
| 2019/0178057 | A1 | 6/2019 | Hunter |
| 2019/0178235 | A1 | 6/2019 | Coskrey |
| 2019/0203567 | A1 | 7/2019 | Ross |
| 2019/0203572 | A1 | 7/2019 | Morris |
| 2019/0211661 | A1 | 7/2019 | Reckels |
| 2019/0226317 | A1 | 7/2019 | Payne |
| 2019/0245348 | A1 | 8/2019 | Hinderliter |
| 2019/0249527 | A1 | 8/2019 | Kraynek |
| 2019/0257462 | A1 | 8/2019 | Rogers |
| 2019/0292866 | A1 | 9/2019 | Ross |
| 2019/0292891 | A1 | 9/2019 | Kajaria |
| 2019/0316447 | A1 | 10/2019 | Oehring |
| 2020/0040878 | A1 | 2/2020 | Morris |
| 2020/0047141 | A1 | 2/2020 | Oehring et al. |
| 2020/0088152 | A1 | 3/2020 | Allion et al. |
| 2020/0232454 | A1 | 7/2020 | Chretien |
| 2020/0325760 | A1 | 10/2020 | Markham |
| 2020/0350790 | A1 | 11/2020 | Luft et al. |

FOREIGN PATENT DOCUMENTS

| | | | |
|---|---|---|---|
| CA | 2707269 | | 12/2010 |
| CA | 2482943 | | 5/2011 |
| CA | 3050131 | | 11/2011 |
| CA | 2955706 | | 10/2012 |
| CA | 2966672 | | 10/2012 |
| CA | 3000322 | | 4/2013 |
| CA | 2787814 | | 2/2014 |
| CA | 2833711 | | 5/2014 |
| CA | 2978706 | | 9/2016 |
| CA | 2944980 | | 2/2017 |
| CA | 3006422 | | 6/2017 |
| CA | 3018485 | | 8/2017 |
| CA | 2964593 | | 10/2017 |
| CA | 2849825 | | 7/2018 |
| CA | 3067854 | A1 | 1/2019 |
| CA | 2919649 | | 2/2019 |
| CA | 2919666 | | 7/2019 |
| CA | 2797081 | | 9/2019 |
| CA | 2945579 | | 10/2019 |
| CN | 201687513 | | 12/2010 |
| CN | 101977016 | | 2/2011 |
| CN | 202023547 | | 11/2011 |
| CN | 102602322 | | 7/2012 |
| CN | 104117308 | A | 10/2014 |
| CN | 104196613 | A | 12/2014 |
| CN | 205986303 | U | 2/2017 |
| CN | 108049999 | A | 5/2018 |
| CN | 112196508 | A | 1/2021 |
| JP | 2004264589 | | 9/2004 |
| WO | 2009046280 | | 4/2009 |
| WO | 2014177346 | | 11/2014 |
| WO | 2016/144939 | | 9/2016 |
| WO | 2016/160458 | | 10/2016 |
| WO | 2018044307 | A1 | 3/2018 |
| WO | 2018213925 | A1 | 11/2018 |
| WO | 2019210417 | | 11/2019 |

OTHER PUBLICATIONS

Non-Final Office Action issued in corresponding U.S. Appl. No. 15/294,349 dated Mar. 14, 2017.

Final Office Action issued in corresponding U.S. Appl. No. 15/145,491 dated Jan. 20, 2017.

Notice of Allowance issued in corresponding U.S. Appl. No. 15/217,040 dated Mar. 28, 2017.

Notice of Allowance issued in corresponding U.S. Appl. No. 14/622,532 dated Mar. 27, 2017.

Non-Final Office Action issued in corresponding U.S. Appl. No. 15/291,842 dated Jan. 6, 2017.

UK Power Networks—Transformers to Supply Heat to Tate Modern—from Press Releases May 16, 2013.

Non-Final Office Action issued in corresponding U.S. Appl. No. 15/486,970 dated Jun. 22, 2017.

Non-Final Office Action issued in corresponding U.S. Appl. No. 15/487,656 dated Jun. 23, 2017.

Non-Final Office Action issued in corresponding U.S. Appl. No. 15/487,694 dated Jun. 26, 2017.

Final Office Action issued in corresponding U.S. Appl. No. 15/294,349 dated Jul. 6, 2017.

Non-Final Office Action issued in corresponding U.S. Appl. No. 14/884,363 dated Sep. 5, 2017.

Final Office Action issued in corresponding U.S. Appl. No. 15/145,491 dated Sep. 6, 2017.

Non-Final Office Action dated Oct. 6, 2017 in related U.S. Appl. No. 14/881,535.

Non-Final Office Action dated Nov. 29, 2017 in related U.S. Appl. No. 15/145,414.

Non-Final Office Action dated Nov. 13, 2017 in related U.S. Appl. No. 15/644,487.

Canadian Office Action dated Mar. 2, 2018 in related Canadian Patent Application No. 2,833,711.

Office Action dated Apr. 10, 2018 in related U.S. Appl. No. 15/294,349.

Office Action dated Apr. 2, 2018 in related U.S. Appl. No. 15/183,387.

Office Action dated May 29, 2018 in related U.S. Appl. No. 15/235,716.

Canadian Office Action dated Apr. 18, 2018 in related Canadian Patent Application No. 2,928,711.

Canadian Office Action dated Jun. 22, 2018 in related Canadian Patent Application No. 2,886,697.

Non-Final Office Action dated Oct. 4, 2018 in related U.S. Appl. No. 15/217,081.

International Search Report and Written Opinion dated Sep. 19, 2018 in related PCT Patent Application No. PCT/US2018/040683.

Canadian Office Action dated Sep. 28, 2018 in related Canadian Patent Application No. 2,945,281.

Office Action dated Dec. 12, 2018 in related U.S. Appl. No. 16/160,708.

International Search Report and Written Opinion dated Jan. 2, 2019 in related PCT Patent Application No. PCT/US18/54542.

International Search Report and Written Opinion dated Jan. 2, 2019 in related PCT Patent Application No. PCT/US18/54548.

(56) References Cited

OTHER PUBLICATIONS

International Search Report and Written Opinion dated Dec. 31, 2018 in related PCT Patent Application No. PCT/US18/55913.
International Search Report and Written Opinion dated Jan. 4, 2019 in related PCT Patent Application No. PCT/US18/57539.
Office Action dated Jul. 25, 2018 in related U.S. Appl. No. 15/644,487.
International Search Report and Written Opinion dated Apr. 10, 2019 in corresponding PCT Application No. PCT/US2019/016635.
Notice of Allowance dated Apr. 23, 2019 in corresponding U.S. Appl. No. 15/635,028.
Schlumberger, "Jet Manual 23, Fracturing Pump Units, SPF/SPS-343, Version 1.0," Jan. 31, 2007, 68 pages.
Stewart & Stevenson, "Stimulation Systems," 2007, 20 pages.
Luis Gamboa, "Variable Frequency Drives in Oil and Gas Pumping Systems," Dec. 17, 2011, 5 pages.
"Griswold Model 811 Pumps: Installation, Operation and Maintenance Manual, ANSI Process Pump," 2010, 60 pages.
Non-Final Office Action dated Feb. 12, 2019 in related U.S. Appl. No. 16/170,695.
International Search Report and Written Opinion dated Feb. 15, 2019 in related PCT Application No. PCT/US18/63977.
Non-Final Office Action dated Feb. 25, 2019 in related U.S. Appl. No. 16/210,749.
International Search Report and Written Opinion dated Mar. 5, 2019 in related PCT Application No. PCT/US18/63970.
Non-Final Office Action dated Mar. 6, 2019 in related U.S. Appl. No. 15/183,387.
Office Action dated Mar. 1, 2019 in related Canadian Patent Application No. 2,943,275.
Office Action dated Jan. 30, 2019 in related Canadian Patent Application No. 2,936,997.
Non-Final Office Action issued in Corresponding U.S. Appl. No. 15/145,491 dated May 15, 2017.
International Search Report and Written Opinion dated Jun. 2, 2020 in corresponding PCT Application No. PCT/US20/23809.
International Search Report and Written Opinion dated Jun. 23, 2020 in corresponding PCT Application No. PCT/US20/23912.
International Search Report and Written Opinion dated Jul. 22, 2020 in corresponding PCT Application No. PCT/US20/00017.
Office Action dated Aug. 4, 2020 in related U.S. Appl. No. 16/385,070.
Office Action dated Jun. 29, 2020 in related U.S. Appl. No. 16/404,283.
Office Action dated Jun. 29, 2020 in related U.S. Appl. No. 16/728,359.
Office Action dated Jun. 22, 2020 in related U.S. Appl. No. 16/377,861.
Canadian Office Action dated Aug. 18, 2020 in related CA Patent Application No. 2,933,444.
Canadian Office Action dated Aug. 17, 2020 in related CA Patent Application No. 2,944,968.
Non-Final Office dated Oct. 26, 2020 in U.S. Appl. No. 15/356,436.
Non-Final Office dated Oct. 5, 2020 in U.S. Appl. No. 16/443,273.
Non-Final Office Action dated Sep. 29, 2020 in U.S. Appl. No. 16/943,727.
Non-Final Office Action dated Sep. 2, 2020 in U.S. Appl. No. 16/356,263.
Non-Final Office Action dated Aug. 31, 2020 in U.S. Appl. No. 16/167,083.
Albone, "Mobile Compressor Stations for Natural Gas Transmission Service," ASME 67-GT-33, Turbo Expo, Power for Land, Sea and Air, vol. 79887, p. 1-10, 1967.
Canadian Office Action dated Sep. 22, 2020 in Canadian Application No. 2,982,974.
International Search Report and Written Opinion dated Sep. 3, 2020 in PCT/US2020/36932.
"Process Burner" (https://www.cebasrt.com/productsloii-gaslprocess-bumer) 06 Sep. 6, 2018 (Sep. 6, 2018), entire document, especially para (Burners for refinery Heaters].
Water and Glycol Heating Systems• (https://www.heat-inc.com/wg-series-water-glycol-systems/) Jun. 18, 2018 (Jun. 18, 2018), entire document, especially WG Series Water Glycol Systems.
"Heat Exchanger" (https://en.wikipedia.org/w/index.php?title=Heat_exchanger&oldid=89300146) Dec. 18, 2019 Apr. 2019 (Apr. 18, 2019), entire document, especially para (0001].
Canadian Office Action dated Sep. 8, 2020 in Canadian Patent Application No. 2,928,707.
Canadian Office Action dated Aug. 31, 2020 in Canadian Patent Application No. 2,944,980.
International Search Report and Written Opinion dated Aug. 28, 2020 in PCT/US20/23821.
International Search Report and Written Opinion dated Jul. 9, 2019 in corresponding PCT Application No. PCT/US2019/027584.
Office Action dated Jun. 11, 2019 in corresponding U.S. Appl. No. 16/210,749.
Office Action dated May 10, 2019 in corresponding U.S. Appl. No. 16/268,030.
Canadian Office Action dated May 30, 2019 in corresponding CA Application No. 2,833,711.
Canadian Office Action dated Jun. 20, 2019 in corresponding CA Application No. 2,964,597.
Office Action dated Jun. 7, 2019 in corresponding U.S. Appl. No. 16/268,030.
International Search Report and Written Opinion dated Sep. 11, 2019 in related PCT Application No. PCT/US2019/037493.
Office Action dated Aug. 19, 2019 in related U.S. Appl. No. 15/356,436.
Office Action dated Oct. 2, 2019 in related U.S. Appl. No. 16/152,732.
Office Action dated Sep. 11, 2019 in related U.S. Appl. No. 16/268,030.
Office Action dated Oct. 11, 2019 in related U.S. Appl. No. 16/385,070.
Office Action dated Sep. 3, 2019 in related U.S. Appl. No. 15/994,772.
Office Action dated Sep. 20, 2019 in related U.S. Appl. No. 16/443,273.
Canadian Office Action dated Oct. 1, 2019 in related Canadian Patent Application No. 2,936,997.
International Search Report and Written Opinion dated Jan. 2, 2020 in related PCT Application No. PCT/US19/55325.
Notice of Allowance dated Jan. 9, 2020 in related U.S. Appl. No. 16/570,331.
Non-Final Office Action dated Dec. 23, 2019 in related U.S. Appl. No. 16/597,008.
Non-Final Office Action dated Jan. 10, 2020 in related U.S. Appl. No. 16/597,014.
Non-Final Office Action dated Dec. 6, 2019 in related U.S. Appl. No. 16/564,186.
International Search Report and Written Opinion dated Nov. 26, 2019 in related PCT Application No. PCT/US19/51018.
International Search Report and Written Opinion dated Feb. 11, 2020 in related PCT Application No. PCT/US2019/055323.
Final Office Action dated Mar. 31, 2020 in related U.S. Appl. No. 15/356,436.
Non-Final Office Action dated Mar. 3, 2020 in related U.S. Appl. No. 16/152,695.
Non-Final Office Action issued in U.S. Appl. No. 14/881,535 dated May 20, 2020.
Non-Final Office Action issued in U.S. Appl. No. 15/145,443 dated May 8, 2020.
Non-Final Office Action issued in U.S. Appl. No. 16/458,696 dated May 22, 2020.
International Search Report and Written Opinion issued in PCT/US2020/023809 dated Jun. 2, 2020.
Karin, "Duel Fuel Diesel Engines," (2015), Taylor & Francis, pp. 62-63, Retrieved from https://app.knovel.com/hotlink/toc/id:kpDFDE0001/dual-fueal-diesel-engines/duel-fuel-diesel-engines (Year 2015).
Goodwin, "High-voltage auxilliary switchgear for power stations," Power Engineering Journal, 1989, 10 pg. (Year 1989).
International Search Report and Written Opinion mailed in PCT/US20/67526 dated May 6, 2021.

(56) References Cited

OTHER PUBLICATIONS

International Search Report and Written Opinion mailed in PCT/US20/67608 dated Mar. 30, 2021.
International Search Report and Written Opinion mailed in PCT/US20/67528 dated Mar. 19, 2021.
International Search Report and Written Opinion mailed in PCT/US20/67146 dated Mar. 29, 2021.
International Search Report and Written Opinion mailed in PCT/US20/67523 dated Mar. 22, 2021.
International Search Report and Written Opinion mailed in PCT/US2020/066543 dated May 11, 2021.
Morris et al., U.S. Appl. No. 62/526,869; Hydration-Blender Transport and Electric Power Distribution for Fracturing Operation; Jun. 28, 2018; USPTO; see entire document.
Final Office Action dated Feb. 4, 2021 in U.S. Appl. No. 16/597,014.
International Search Report and Written Opinion dated Feb. 4, 2021 in PCT/US20/59834.
International Search Report and Written Opinion dated Feb. 2, 2021 in PCT/US20/58906.
International Search Report and Written Opinion dated Feb. 3, 2021 in PCT/US20/58899.
Non-Final Office Action dated Jan. 29, 2021 in U.S. Appl. No. 16/564,185.
Final Office Action dated Jan. 21, 2021 in U.S. Appl. No. 16/458,696.
Final Office Action dated Jan. 11, 2021 in U.S. Appl. No. 16/404,283.
Non-Final Office Action dated Jan. 4, 2021 in U.S. Appl. No. 16/522,043.
International Search Report and Written Opinion dated Dec. 14, 2020 in PCT/US2020/53980.
Non-Final Office Action issued in U.S. Appl. No. 16/871,928 dated Aug. 25, 2021.
Non-Final Office Action issued in U.S. Appl. No. 16/943,727 dated Aug. 3, 2021.
Non-Final Office Action issued in U.S. Appl. No. 14/881,525 dated Jul. 21, 2021.
Non-Final Office Action issued in U.S. Appl. No. 16/404,283 dated Jul. 21, 2021.
Notice of Allowance and Notice of Allowability issued in U.S. Appl. No. 15/829,419 dated Jul. 26, 2021.
Woodbury et al., "Electrical Design Considerations for Drilling Rigs," IEEE Transactions on Industry Applications, vol. 1A-12, No. 4, Jul./Aug. 1976, pp. 421-431.
Kroposki et al., Making Microgrids Work, 6 IEEE Power and Energy Mag. 40, 41 (2008).
Dan T. Ton & Merrill A. Smith, The U.S. Department of Energy's Microgrid Initiative, 25 The Electricity J. 84 (2012), pp. 84-94.
Non-Final Office Action issued in U.S. Appl. No. 16/871,328 dated Dec. 9, 2021.
Non-Final Office Action issued in U.S. Appl. No. 16/943,935 dated Oct. 21, 2021.
Non-Final Office Action issued in U.S. Appl. No. 16/564,186, dated Oct. 15, 2021.
Final Office Action issued in U.S. Appl. No. 16/356,263 dated Oct. 7, 2021.
Non-Final Office Action issued in U.S. Appl. No. 17/060,647 dated Sep. 20, 2021.
Non-Final Office Action issued in U.S. Appl. No. 16/901,774 dated Sep. 14, 2021.
Canadian Office Action issued in Canadian Application No. 3,094,768 dated Oct. 28, 2021.

* cited by examiner

SUCTION AND DISCHARGE LINES FOR A DUAL HYDRAULIC FRACTURING UNIT

CROSS REFERENCE TO RELATED APPLICATIONS

This application is a continuation of, and claims priority to and the benefit of, U.S. Provisional Application Ser. No. 62/156,301, filed May 3, 2015 and is a continuation-in-part of, and claims priority to and the benefit of U.S. patent application Ser. No. 13/679,689, filed Nov. 16, 2012, the full disclosures of which are hereby incorporated by reference herein for all purposes.

BACKGROUND OF THE INVENTION

1. Field of Invention

The present disclosure relates to hydraulic fracturing of subterranean formations. In particular, the present disclosure relates to orienting piping connected to a fracturing pump so that connections in the piping are provided where the piping is oblique to a horizontal axis of the pump.

2. Description of Prior Art

Hydraulic fracturing is a technique used to stimulate production from some hydrocarbon producing wells. The technique usually involves injecting fluid into a wellbore at a pressure sufficient to generate fissures in the formation surrounding the wellbore. Typically the pressurized fluid is injected into a portion of the wellbore that is pressure isolated from the remaining length of the wellbore so that fracturing is limited to a designated portion of the formation. The fracturing fluid slurry, whose primary component is usually water, includes proppant (such as sand or ceramic) that migrate into the fractures with the fracturing fluid slurry and remain to prop open the fractures after pressure is no longer applied to the wellbore. A primary fluid for the slurry other than water, such as nitrogen, carbon dioxide, foam, diesel, or other fluids may be used as the primary component instead of water. A typical hydraulic fracturing fleet may include an data van unit, blender unit, hydration unit, chemical additive unit, hydraulic fracturing pump unit, sand equipment, wireline, and other equipment.

Traditionally, the fracturing fluid slurry has been pressurized on surface by high pressure pumps powered by diesel engines. To produce the pressures required for hydraulic fracturing, the pumps and associated engines have substantial volume and mass. Heavy duty trailers, skids, or trucks are required for transporting the large and heavy pumps and engines to sites where wellbores are being fractured. Each hydraulic fracturing pump usually includes power and end fluid ends, as well as seats, valves, springs, and keepers internally. Each pump is usually equipped with a water manifold (referred to as a fluid end) which contains seats, valves, and keepers internally. These parts allow the pump to draw in low pressure fluid (approximately 100 psi) and discharge the same fluid at high pressures (up to 15,000 psi or more). Traditional diesel powered hydraulic fracturing pump units only have one diesel engine, one transmission, and one hydraulic fracturing pump per unit. Recently electrical motors have been introduced to replace the diesel motors, which greatly reduces the emissions and noise generated by the equipment during operation. Because the pumps are generally transported on trailers, connections between segments of pump suction and discharge piping are generally made up in the field. Moreover, the segments having these connections extend horizontally or vertically, and which are difficult connections for operations personnel to handle. Prior turbine powered hydraulic fracturing units with two hydraulic pumps on each unit had one supply line that fed both pumps. Also the discharge lines from both hydraulic fracturing pumps were combined into one discharge line while the unit.

SUMMARY OF THE INVENTION

Disclosed herein is an example of a hydraulic fracturing system for fracturing a subterranean formation, and which includes a trailer having wheels, an electrically powered fracturing pump mounted on the trailer, a supply line having fracturing fluid, and a hard piped suction lead line. In another embodiment, the trailer is replaced by any platform such as a skid or a truck. Suction lead line is made up of a main segment connected to a suction inlet on the electrically powered pump and a tip segment that is angled obliquely to a portion of the main segment proximate the tip segment, an end of the tip segment is connected to an end of the main segment distal from the suction inlet, and the tip segment further having an end distal from the main segment that is connected to an end of the supply line. In one example, the pump, supply line, suction lead line, main segment, and tip segment each respectively make up a first pump, a first supply line, a first suction lead, a first main segment, and a first tip segment, this example of the hydraulic fracturing system further includes a second pump, a second supply line, a second suction lead, a second main segment, and a second tip segment, and wherein the second tip segment is angled with respect to the first tip segment. In one example, the tip segment is angled from about 22 degrees to about 45 degrees with respect to a portion of the main segment proximate the tip segment; and can optionally be angled at about 22 degrees with respect to a portion of the main segment proximate the tip segment. In one alternative, the first tip segment is angled at about 22 degrees with respect to a portion of the first main segment proximate the first tip segment, and the second tip segment is angled at about 45 degrees with respect to a portion of the second main segment proximate the second tip segment. The supply line can be a flexible line made from an elastomeric material. In one alternate embodiment, the tip segment extends away from the main segment in a direction that projects towards a surface on which the trailer is supported. In one embodiment, the supply line for a first pump is separate and distinct from the supply line for a second pump while on the unit. Boost pressure for both the first and second hydraulic fracturing pumps may come from the same blender. The system can further include a hard piped discharge lead line which is made up of a main segment connected to a discharge on the electrically powered pump, and a tip segment that is angled obliquely to a portion of the main segment proximate the tip segment, and having an end connected to an end of the main segment distal from the discharge, and further having an end distal from the main segment that is connected to an end of a discharge line. In one embodiment, the tip segment for the discharge line is parallel with a horizontal plane and is not angled down. In an alternative where the pump, discharge line, discharge lead line, main segment, and tip segment each respectively are a first pump, a first discharge line, a first discharge lead, a first main segment, and a first tip segment, and the hydraulic fracturing system further includes a second pump, a second discharge line, a second discharge lead, a second main segment, and a second tip segment, the second tip segment is angled with respect to the first tip segment. In this example, the tip segment is angled from about 22 degrees to about 45 degrees with respect to a portion of the main segment proximate the tip segment. Optionally, the first tip segment is angled at about 22 degrees with respect to a portion of the first main segment proximate the first tip segment, and wherein the second tip segment is angled at about 45 degrees with respect to a portion of the second main segment proximate the second tip segment. In one embodiment, the tip segment for the discharge line for the first pump is parallel with a horizontal plane and is not angled down. The tip segment for the discharge line for the first pump is offset from the discharge line for the second pump.

Another example of a hydraulic fracturing system for fracturing a subterranean formation includes an electrically powered fracturing pump mounted on a mobile platform, a lead line in fluid communication with the pump and having a tip portion that is oriented along an axis that is oblique to a horizontal axis, and a flow line connected to the tip portion and that is in fluid communication with the lead line. In one example, the axis along which the tip portion is oriented is a first axis, and wherein an angle is defined between the first axis and the horizontal axis that ranges from around 22 degrees to around 45 degrees. The pump, lead line, axis, and flow line each respectively can be referred to as a first pump, a first lead line, a first tip portion, a first axis, and a first flow line, and in this example the hydraulic fracturing system further includes a second pump, a second lead line, a second tip portion, and a second flow line, and wherein the second tip portion extends along a second axis that is oblique with the first axis and the horizontal axis. In this example, the first axis can be an at angle of around 22 degrees with respect to the horizontal axis, and wherein the second axis can be at an angle of around 45 degrees with respect to the horizontal axis. The lead line can optionally be a suction lead line, and the flow line can be a supply line, in this example the hydraulic fracturing system further includes a discharge lead line having a tip portion and a discharge line, and wherein the tip portion of the discharge lead line extends along another axis that is oblique to the horizontal axis. In one embodiment, the discharge lead line and tip portion are parallel with the horizontal axis of the platform and are not angled. In this example, the supply line contains fracturing fluid from a blender, and wherein the discharge line contains fracturing fluid pressurized by the pump.

Another example of a hydraulic fracturing system for fracturing a subterranean formation includes a trailer, a first electrically powered pump mounted on the trailer and having a suction lead line with an end connected to a supply line and that is angled in a range of from around 22 degrees to around 45 degrees with respect to a horizontal axis, and having a discharge lead line with an end connected to a discharge line that is angled in a range of from around 22 degrees to around 45 degrees with respect to the horizontal axis, and a second electrically powered pump mounted on the trailer and having a suction lead line with an end connected to a supply line and that is angled in a range of from around 22 degrees to around 45 degrees with respect to the horizontal axis, and having a discharge lead line with an end connected to a discharge line that is angled in a range of from around 22 degrees to around 45 degrees with respect to the horizontal axis. In one embodiment, the discharge line is not angled and is parallel with the horizontal axis of the trailer.

BRIEF DESCRIPTION OF DRAWINGS

Some of the features and benefits of the present invention having been stated, others will become apparent as the description proceeds when taken in conjunction with the accompanying drawings, in which.

Figure 1:
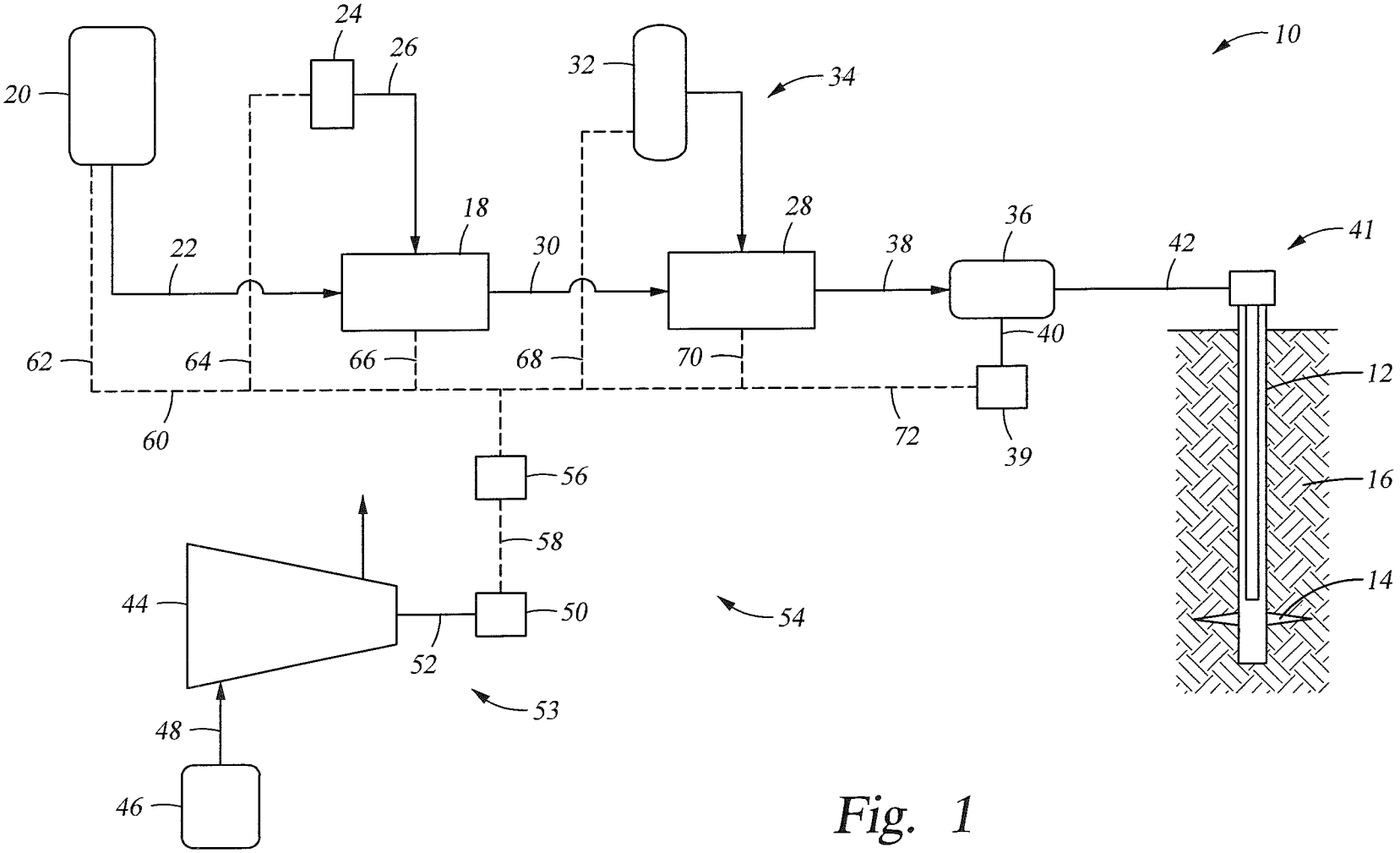
FIG. 1 is a schematic of an example of a hydraulic fracturing system.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a schematic example of a hydraulic fracturing system 10 that is used for pressurizing a wellbore 12 to create fractures 14 in a subterranean formation 16 that surrounds the wellbore 12. Included with the system 10 is a hydration unit 18 that receives fluid from a fluid source 20 via line 22, and also selectively receives additives from an additive source 24 via line 26. Additive source 24 can be separate from the hydration unit 18 as a stand-alone unit, or can be included as part of the same unit as the hydration unit 18. The fluid, which in one example is water, is mixed inside of the hydration unit 18 with the additives. In an embodiment, the fluid and additives are mixed over a period of time to allow for uniform distribution of the additives within the fluid. In the example of FIG. 1, the fluid and additive mixture is transferred to a blender unit 28 via line 30. A proppant source 32 contains proppant, which is delivered to the blender unit 28 as represented by line 34, where line 34 can be a conveyer. Inside the blender unit 28, the proppant and fluid/additive mixture are combined to form a fracturing slurry, which is then transferred to a fracturing pump system 36 via line 38; thus fluid in line 38 includes the discharge of blender unit 28 which is the suction (or boost) for the fracturing pump system 36. Blender unit 28 can have an onboard chemical additive system, such as with chemical pumps and augers. Optionally, additive source 24 can provide chemicals to blender unit 28; or a separate and stand-alone chemical additive system (not shown) can be provided for delivering chemicals to the blender unit 28. In an example, the pressure of the slurry in line 38 ranges from around 80 psi to around 100 psi. The pressure of the slurry can be increased up to around 15,000 psi by pump system 36. A motor 39, which connects to pump system 36 via connection 40, drives pump system 36 so that it can pressurize the slurry. In one example, the motor 39 is controlled by a variable frequency drive ("VFD"). In one embodiment, a motor 39 may connect to a first pump system 36 via connection 40 and to a second pump system 36 via a second connection 40. After being discharged from pump system 36, slurry is pumped into a wellhead assembly 41; discharge piping 42 connects discharge of pump system 36 with wellhead assembly 41 and provides a conduit for the slurry between the pump system 36 and the wellhead assembly 41. In an alternative, hoses or other connections can be used to provide a conduit for the slurry between the pump system 36 and the wellhead assembly 41. Optionally, any type of fluid can be pressurized by the fracturing pump system 36 to form injection fracturing fluid that is then pumped into the wellbore 12 for fracturing the formation 14, and is not limited to fluids having chemicals or proppant.

An example of a turbine 44 is provided in the example of FIG. 1 and which receives a combustible fuel from a fuel source 46 via a feed line 48. In one example, the combustible fuel is natural gas, and the fuel source 46 can be a container of natural gas or a well (not shown) proximate the turbine 44. Combustion of the fuel in the turbine 44 in turn powers a generator 50 that produces electricity. Shaft 52 connects generator 50 to turbine 44. The combination of the turbine 44, generator 50, and shaft 52 define a turbine generator 53. In another example, gearing can also be used to connect the turbine 44 and generator 50. An example of a micro-grid 54 is further illustrated in FIG. 1, and which distributes electricity generated by the turbine generator 53. Included with the micro-grid 54 is a transformer 56 for stepping down voltage of the electricity generated by the generator 50 to a voltage more compatible for use by electrical powered devices in the hydraulic fracturing system 10. In another example, the power generated by the turbine generator and the power utilized by the electrical powered devices in the hydraulic fracturing system 10 are of the same voltage, such as 4160 V so that main power transformers are not needed. In one embodiment, multiple 3500 kVA dry cast coil transformers are utilized. Electricity generated in generator 50 is conveyed to transformer 56 via line 58. In one example, transformer 56 steps the voltage down from 13.8 kV to around 600 V. Other step down voltages can include 4,160 V, 480 V, or other voltages. The output or low voltage side of the transformer 56 connects to a power bus 60, lines 62, 64, 66, 68, 70, and 72 connect to power bus 60 and deliver electricity to electrically powered end users in the system 10. More specifically, line 62 connects fluid source 20 to bus 60, line 64 connects additive source 24 to bus 60, line 66 connects hydration unit 18 to bus 60, line 68 connects proppant source 32 to bus 60, line 70 connects blender unit 28 to bus 60, and line 72 connects motor 39 to bus 60. In an example, additive source 24 contains ten or more chemical pumps for supplementing the existing chemical pumps on the hydration unit 18 and blender unit 28. Chemicals from the additive source 24 can be delivered via lines 26 to either the hydration unit 18 and/or the blender unit 28. In one embodiment, the elements of the system 10 are mobile and can be readily transported to a wellsite adjacent the wellbore 12, such as on trailers or other platforms equipped with wheels or tracks.

Figure 2:
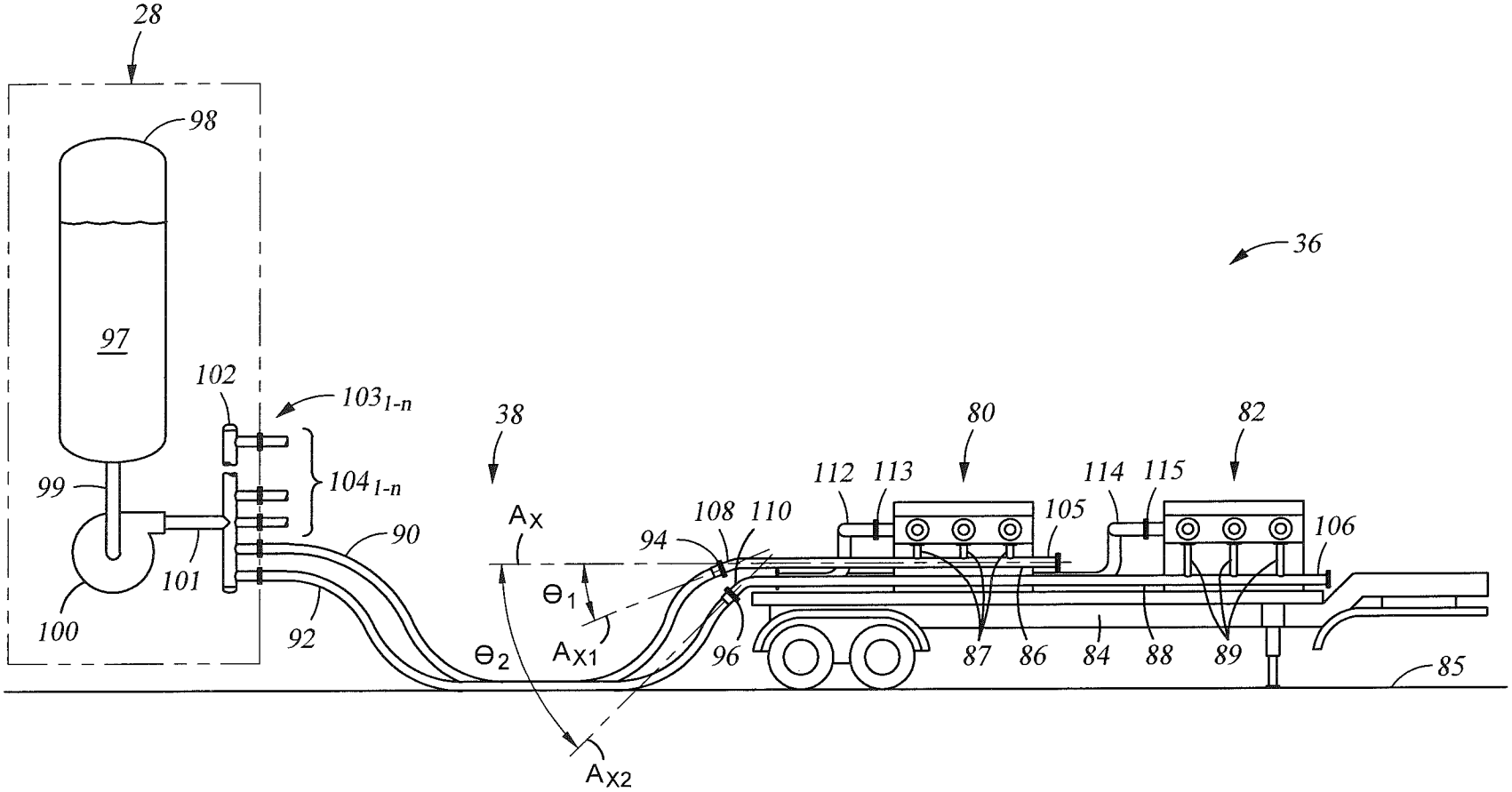
FIGS. 2 and 3 are side views of examples of piping for a fracturing pump having connections in obliquely oriented segments of the piping.

FIG. 2 shows in a side view a schematic example of a portion of the hydraulic fracturing system 10 of FIG. 1 and which includes a pair of pumps 80, 82 mounted on a trailer 84. In another embodiment, the platform 84 may be a truck or one or more skids. The pumps 80, 82 and trailer 84 make up one example of a fracturing pump system 36 and which is used for pressurizing fracturing fluid that is then transmitted to the wellhead assembly 41 of FIG. 1. Trailer 84 is shown mounted on a surface 85, which can be any surface proximate wellhead assembly 41 (FIG. 1), such as a paved or unpaved road, a pad (formed from concrete or a mat), gravel, or the Earth's surface. As shown, surface 85 is generally parallel with a horizontal axis $A_X$ which provides one example of a reference axis for comparing relative angles thereto. Further included with the fracturing pump system 36 of FIG. 2 is a suction lead line 86 which is substantially supported on top of trailer 84. In the illustrated example, lead line 86 is hard piped, e.g., formed from metal or other generally non-pliable material. Suction lead line 86 provides a conduit for fracturing fluids supplied from the blender unit 28 and to the suction inlets 87 provided on pump 80. While three suction inlets 87 are shown on pump 80, any number of inlets may be provided depending on the design and application of pump 80. Another suction lead line 88 is provided on trailer 84 which connects to suction inlets 89 formed on pump 82, suction lead line 88 is also hard piped. Suction lead lines 86, 88 respectively couple to supply lines 90, 92, both of which carry fracturing fluid from blender unit 28 and across the distance between blender unit 28 and fracturing pump system 36. In one example supply lines 90, 92 are generally flexible and include elastomeric material. Connections 94, 96 provide a coupling between the suction lead lines 86, 88 and supply lines 90, 92. Connections 94, 96 can be flanged or threaded and may include any different number of connections that are appropriate for use in a field application, such as compression fittings, threaded unions, hammer lug unions, and the like. Fracturing fluid 97 is shown stored within tub 98 which is part of the blender unit 28 and as described above provides a place for preparing fracturing fluid to be used in a fracturing environment. Fracturing fluid 97 is directed from tub 98 through piping 99 to a discharge pump 100 which pressurizes or boosts fracturing fluid 97 for transmitting the fracturing fluid 97 to the fracturing pump system 36. Piping 101 attached to a discharge end of pump 100 directs the pressurized fracturing fluid to a manifold 102. Connections $\mathbf{103}_{1\text{-}n}$ formed on manifold 102 attach to supply lines $\mathbf{104}_{1\text{-}n}$, which are similar to supply lines 90, 92 and that direct the fracturing fluid to pumps (not shown). Pumps connected to supply lines $\mathbf{104}_{1\text{-}n}$ are similar to pumps 80, 82, and are also part of the fracturing pump system 36.

Suction lead lines 86, 88 of FIG. 2 each include main segments 105, 106; which make up portions of the suction lead lines 86, 88 on the trailer 84 and distal from the supply lines 90, 92. Suction lead lines 86, 88 also include tip segments 108, 110, which include portions of the suction lead lines 86, 88 that connect to ends of main segments 105, 106 respectively, and that are proximate to and connect with the supply lines 90, 92. As shown, tip segments 108, 110 are shown extending along axes $A_{X1}$, $A_{X2}$ that are oblique with respect to horizontal axis $A_X$. By obliquely angling the tip segments 108, 110, operations personnel experience significantly less difficulty in connecting the supply lines 90, 92 to the suction lead lines 86, 88. When connecting/disconnecting a supply line 90, 92 from an obliquely angled tip segment 108, 110 allows operations personnel to hold the portion of the supply lines 90, 92 spaced away from the suction leads 86, 88 vertically lower than the end at the connection 94, 96; which is a more natural and less cumbersome orientation for operations personnel. The angled connections also generate less stress on the supply lines 90, 92 which may lengthen their life and minimize failures The angled holding of the supply lines 90, 92 is in contrast to the generally horizontal or vertical orientations of ends of traditional suction lead lines, which requires that the rearward portions of the supply lines 90, 92 at the same vertical level as the ends at the connections 94, 96.

In one non-limiting example, axis $A_{X1}$ is at an angle $\theta_1$ of around 22° with respect to horizontal axis $A_X$. Optionally, axis $A_{X2}$ is at an angle $\theta_2$ of around 45° with respect to horizontal axis $A_X$. An additional advantage is realized by offsetting the angles of the adjacent tip segments 108, 110 as not only can personnel realize the advantage of the non-horizontal orientation of these tip segments 108, 110 when attaching or moving the supply lines 90, 92, but angularly offsetting the adjacent tip segments 108, 110 reduces interference of operation between these two tip segments 108, 110. It should be pointed out, however, that the axes $A_{X1}$, $A_{X2}$ along which the tip segments 108, 110 are oriented can range between around 22° and up to around 45° from the horizontal axis $A_X$. Additionally, the offset angles between axes $A_{X1}$, $A_{X2}$ and horizontal axis $A_X$ can be less than 22°. In FIG. 2, tip segments 108, 110 are shown projecting along a path that intersects with surface 85. However, embodiments exist wherein one or both of tip segments 108, 110 extend along a path that projects away from surface 85.

Figure 3:
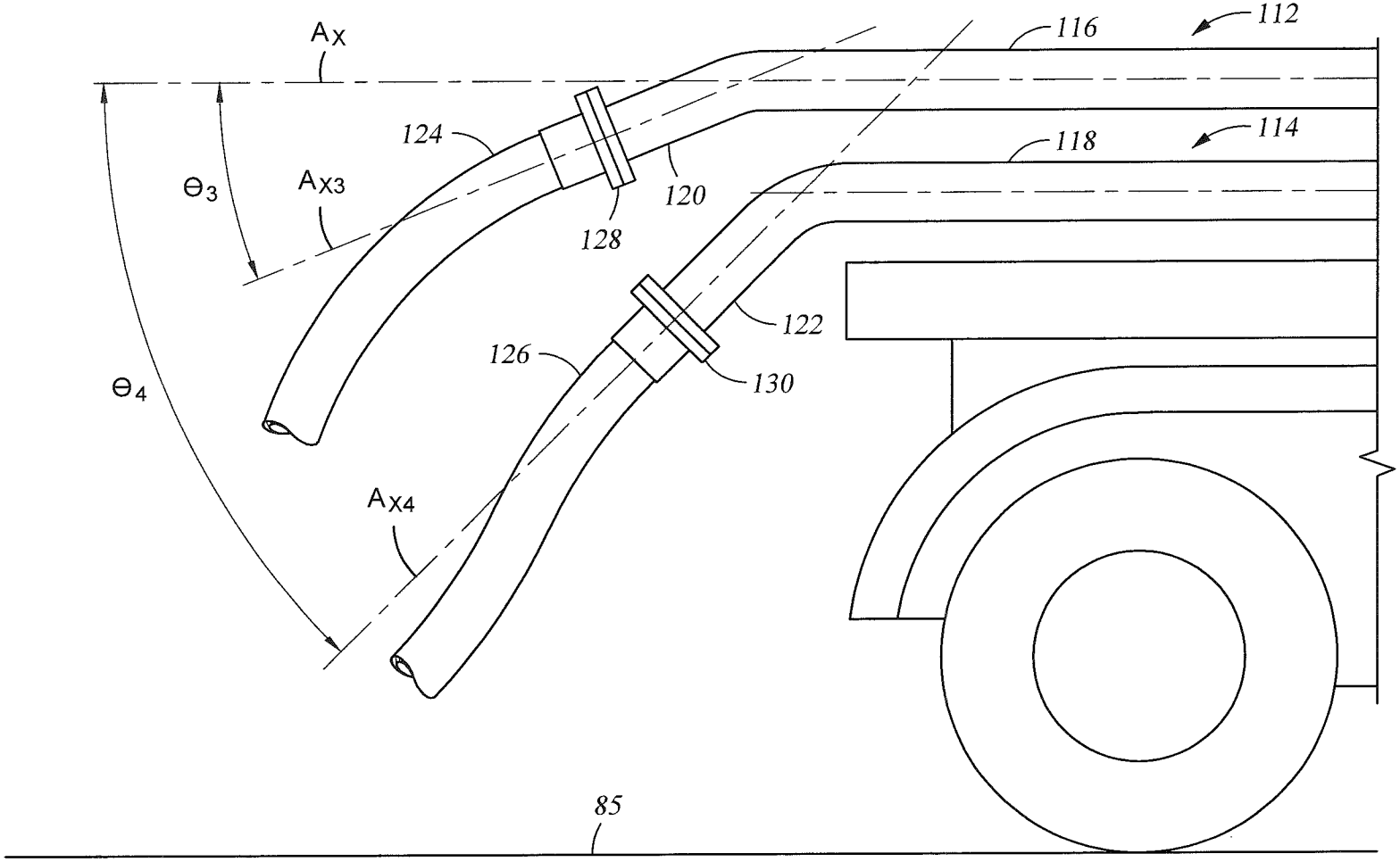

Further shown in FIG. 2 is a discharge lead line 112 which is shown connecting to a discharge 113 mounted on a high pressure side of pump 80. A discharge line 114 is shown connecting to a discharge 115 mounted on the high pressure side of pump 82. Referring now to the example of FIG. 3, shown is that discharge lead lines 112, 114 each include main segments 116, 118 and which are primarily mounted on trailer 84. The ends of the discharge lead lines 102, 114 distal from pumps 80, 82 are angled to define tip segments 120, 122 which as shown are oriented respectively along axes $A_{X3}$, $A_{X4}$. Like axes $A_{X1}$, $A_{X2}$ of FIG. 2, axes $A_{X3}$, $A_{X4}$ of FIG. 3 project at angles with respect to horizontal axis $A_X$ that are oblique. More specifically, $A_{X3}$ is shown at an angle of $\theta_3$ with respect to horizontal axis $A_X$, and axis $A_{X4}$ is at an angle of $\theta_4$ with respect to horizontal axis $A_X$. Similar to the tip segments 108, 110 of FIG. 2, obliquely angling of the tip segments 120, 122 provides an easier connection and disconnection of discharge lines 124, 126 shown respectively coupled to the ends of the tip segments 120, 122. Connections 128, 130 are illustrated that provide connection between the discharge lines 124, 126 and tip segments 120, 122. In one optional embodiment, tip segments 108, 110, 120, 122 extend across the outer periphery of the upper surface of trailer 84. Example connections 128, 130 include flange connections, threaded connections, unions, hammer unions, quick disconnect connections, and the like. In one embodiment, the ends of the two discharge lead lines for the first pump and the second pump are parallel to the horizontal plane and are offset from each other.

Figure 4:
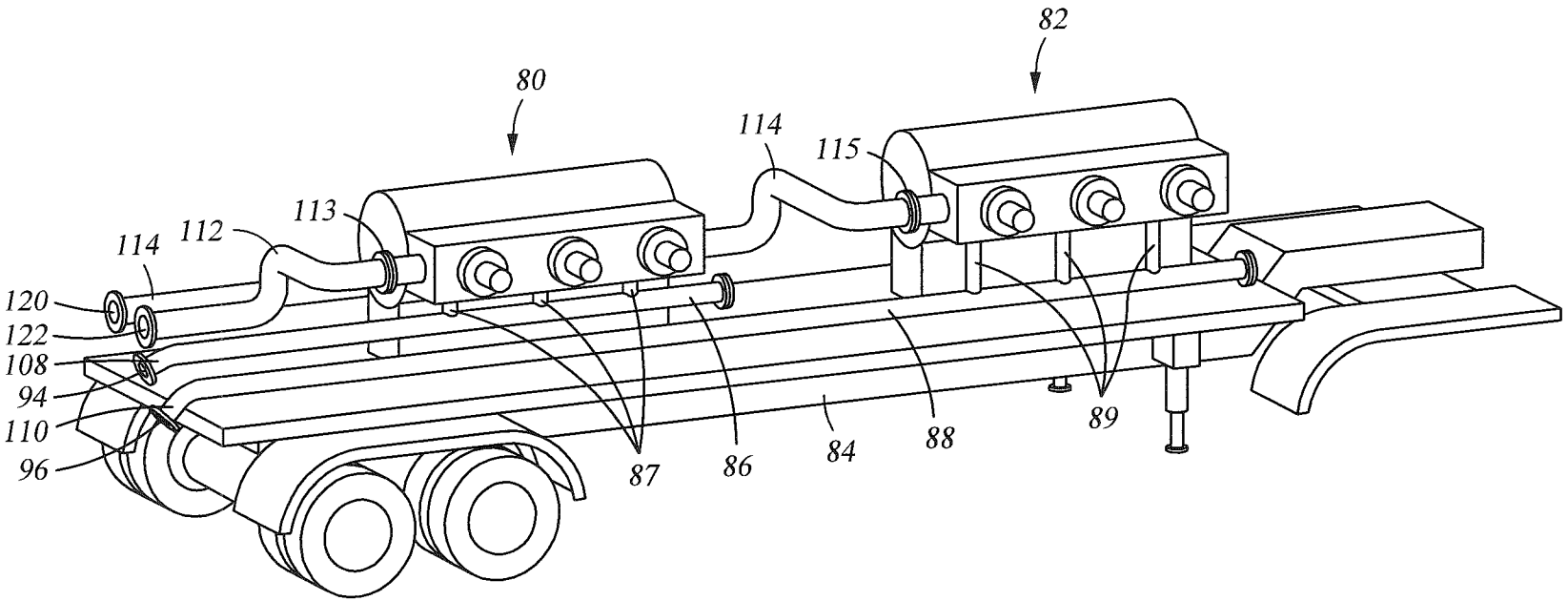
FIG. 4 is an end perspective view of an example of an example fracturing pumps on a trailer having separate and distinct suction and discharge piping.

Further shown in the example of FIG. 4 are hydraulic fracturing pumps 80, 82 mounted on trailer 84. In the illustrated embodiment, suction line 88 and the discharge line 114 fluidly connected to pump 80 and are routed underneath the fluid end of pump 82. Further in this example, the discharge tip segments 120, 122 are offset from one another, but are oriented along paths that are generally parallel with the trailer 84 and surface 85 on which trailer 84 is supported. As shown, the discharge lead lines 112, 114 and respective tip segments 120, 122 remain separate from one another so that pressurized slurry from the pumps 80, 82 remains in separate conduits while on and adjacent trailer 84. Lines 86, 88 and associated tip segments 108, 110 are also kept apart from one another while on and adjacent trailer 84 As indicated above, separating these fluid flow lines, especially proximate the pumps 80, 82 reduces vibration in the hardware coupled with the pumps 80, 82, and flow lines carrying slurry to and from the pumps 80, 82.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A hydraulic fracturing system for fracturing a subterranean formation comprising:

a plurality of electrically powered fracturing pumps mounted on a trailer, each of the plurality of electrically powered fracturing pumps attached to a corresponding first lead line and a corresponding second lead line;

wherein each of the first lead lines and the second lead lines are separate and apart from one another while on the trailer, each of the first and second lead lines comprising a main segment attached to at least one of the plurality of electrically powered fracturing pumps, and a tip segment that is angled obliquely to a portion of the main segment proximate the tip segment, wherein the tip segment of each of the first lead lines is angled differently with respect to the main segment than the tip segment of the corresponding second lead line, and wherein the main segment and the tip segment comprise a unitary pipe segment; and flow lines in fluid communication with the lead lines.

2. The hydraulic fracturing system of claim 1, wherein the tip segment of each lead line extends along an axis that angles away from a horizontal axis from around 22 degrees to around 45 degrees.

3. The hydraulic fracturing system of claim 2, wherein the tip segment of the first lead line is oriented at an angle of around 22 degrees with respect to the horizontal axis, and segment of the second lead line is oriented at an angle of around 45 degrees with respect to the horizontal axis.

4. The hydraulic fracturing system of claim 1, wherein the lead lines comprise suction lead lines, the system further comprising discharge lead lines that extend along paths that are generally parallel with the horizontal axis, and wherein the suction lead lines connect to a supply line that contains fracturing fluid from a blender, and the discharge line contains fracturing fluid pressurized by the pump.

* * * * *